US007574163B2

(12) United States Patent
Sato

(10) Patent No.: US 7,574,163 B2
(45) Date of Patent: Aug. 11, 2009

(54) TONER CARTRIDGE

(75) Inventor: Tsutomu Sato, Izunokuni (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/749,277

(22) Filed: May 16, 2007

(65) Prior Publication Data

US 2007/0269237 A1 Nov. 22, 2007

(30) Foreign Application Priority Data

May 18, 2006 (JP) ..... 2006-139190

(51) Int. Cl.
*G03G 15/08* (2006.01)

(52) U.S. Cl. ..... 399/260

(58) Field of Classification Search ..... 399/258–263
See application file for complete search history.

(56) References Cited

U.S. PATENT DOCUMENTS

| | | | | |
|---|---|---|---|---|
| 5,206,692 | A * | 4/1993 | Ishida et al. | 399/258 |
| 5,761,586 | A * | 6/1998 | Kawashima et al. | 399/262 |
| 6,438,345 | B1 * | 8/2002 | Ban et al. | 399/262 |
| 6,526,243 | B2 | 2/2003 | Kim et al. | |
| 6,564,029 | B2 * | 5/2003 | Kojima et al. | 399/258 |
| 6,584,293 | B1 | 6/2003 | Wang et al. | |
| 2002/0085857 | A1 | 7/2002 | Kim et al. | |
| 2006/0210319 | A1 | 9/2006 | Katsuyama | |

FOREIGN PATENT DOCUMENTS

| | | |
|---|---|---|
| CN | 1722021 | 1/2006 |
| EP | 1211570 | 6/2002 |
| EP | 1403734 | 3/2004 |
| EP | 1617296 | 1/2006 |
| JP | 2006-030569 | 2/2006 |

OTHER PUBLICATIONS

European Search Report dated Aug. 20, 2007.
Chinese Office Action dated Sep. 19, 2008 corresponding to U.S. Appl. No. 11/479,277, filed May 16, 2007.

* cited by examiner

*Primary Examiner*—David M Gray
*Assistant Examiner*—Erika Villaluna
(74) *Attorney, Agent, or Firm*—Turocy & Watson, LLP

(57) ABSTRACT

A toner cartridge provided in an image forming apparatus in a removable manner for supplying toner to the image forming apparatus, the cartridge includes toner cartridge main body which contains the toner, a discharging opening for supplying the toner contained in the toner cartridge main body to the image forming apparatus and a shutter which opens the discharging opening when the toner cartridge main body is inserted in the image forming apparatus and closes the discharging opening when the toner cartridge main body is removed from the image forming apparatus, wherein the shutter has a concave part formed therein for engaging with a holding member which holds the shutter provided in the image forming apparatus to open and close the discharging opening when the toner cartridge main body is inserted in or removed from the image forming apparatus.

8 Claims, 15 Drawing Sheets

TONER CARTRIDGE

CROSS-REFERENCE TO RELATED APPLICATIONS

This application is based upon and claims the benefit of priority from prior Japanese Patent Application No. 2006-139190, filed May 18, 2006, the entire contents of which are incorporated herein by reference.

BACKGROUND OF THE INVENTION

1. Field of the Invention

The present invention relates to a toner cartridge for supplying toner to an image forming apparatus.

2. Description of the Related Art

An image forming apparatus has a toner cartridge for supplying toner to the apparatus. The toner cartridge is inserted in the image forming apparatus in a removable manner. In addition, a filling opening is provided in the toner cartridge and the toner is supplied through the filling opening. In the toner cartridge, a mixer is rotated constantly so as to prevent the toner from solidifying inside the toner cartridge.

The toner cartridge is configured such that the user can exchange the toner cartridge himself or herself when toner in the toner cartridge is used up.

Jpn. Pat. Appln. Publication No. 2006-30569 discloses a configuration in which a supplying opening of a toner cartridge is open and closed by a hook provided in an image forming apparatus pressing a movable shutter provided at the supplying opening when the user mounts or removes the toner cartridge.

However, the hook for pressing the shutter is oriented toward a front side of the image forming apparatus main body. When the user pulls out the toner cartridge from the image forming apparatus main body and if the cartridge cannot be pulled out smoothly, the user may pull out the cartridge by opening the hook by hand. In this case, the toner cartridge is pulled out without the supplying opening of toner being closed by the shutter. Thereby, there has been a problem that a large amount of toner spills out.

The present invention has been made in view of the above circumstances. An object of the present invention is to provide a toner cartridge which can easily be inserted in and removed from an image forming apparatus and is easy to handle.

BRIEF SUMMARY OF THE INVENTION

According to one aspect of the present invention, there is provided a toner cartridge comprising: a toner cartridge main body which contains the toner, a discharging opening for supplying the toner contained in the toner cartridge main body to the image forming apparatus, and a shutter which opens the discharging opening when the toner cartridge main body is inserted in the image forming apparatus and closes the discharging opening when the toner cartridge main body is removed from the image forming apparatus, wherein the shutter has a concave part formed therein for engaging with a holding member which holds the shutter provided in the image forming apparatus to open and close the discharging opening when the toner cartridge main body is inserted in or removed from the image forming apparatus.

DETAILED DESCRIPTION OF THE INVENTION

Hereinafter, a preferred embodiment for carrying out the present invention will be described.

Figure 1:
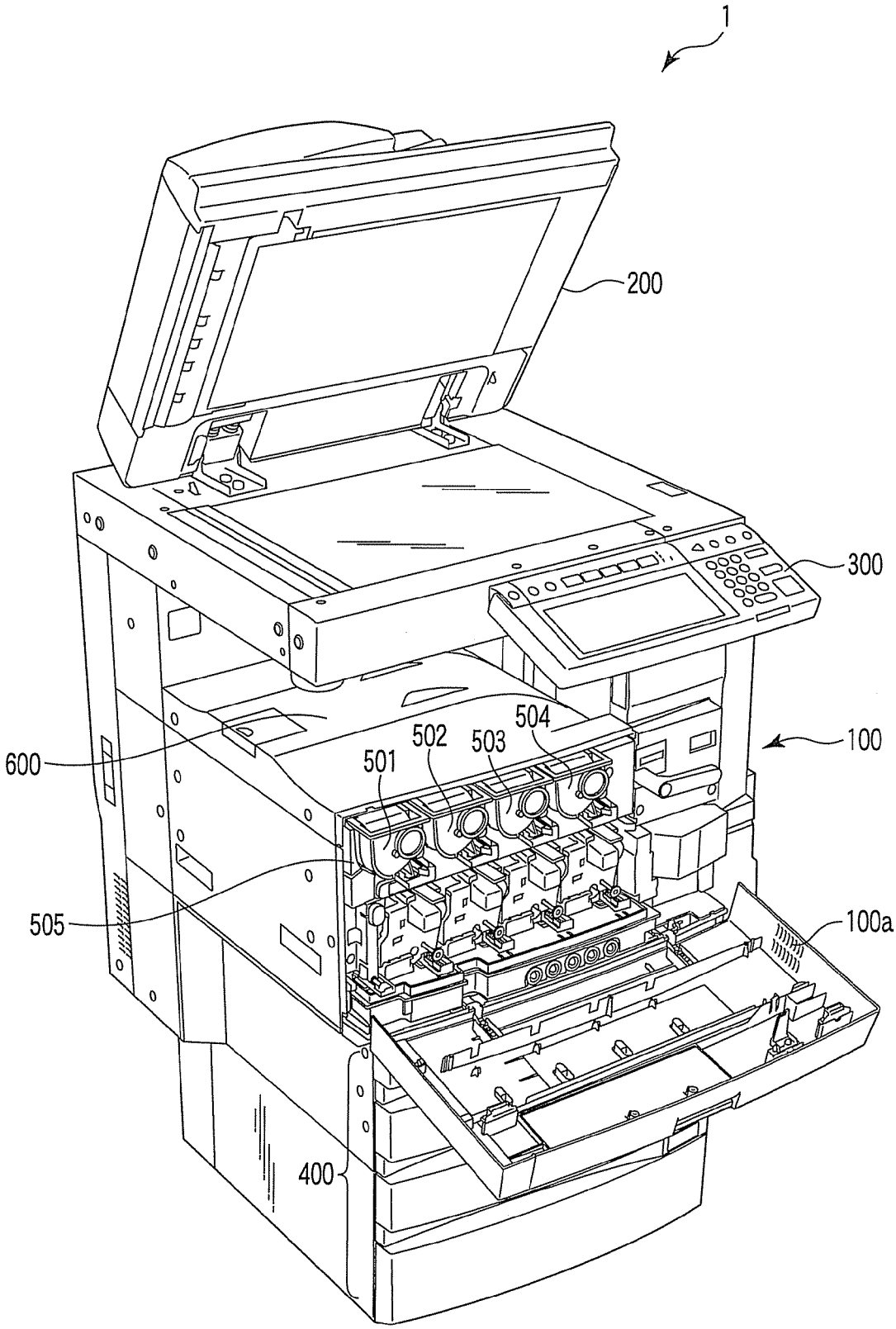
FIG. 1 is a schematic view showing an internal structure of an image forming apparatus according to one embodiment of the present invention.

FIG. 1 is a perspective view of a schematic view showing an internal structure of an image forming apparatus 1 according to an embodiment of the present invention. As shown in FIG. 1, the image forming apparatus 1 is a color copier of a quadruple tandem system. The image forming apparatus 1 includes a copier main body 100, a platen cover 200, a control panel 300, and a plurality of paper feeding cassettes 400.

The copier main body 100 plays a major role in image forming, and has a cover 100*a* provided on a front surface thereof in an openable and closable manner. When the cover 100*a* is opened, first to fourth toner cartridges 501 to 504 are found to be arranged in alignment on an upper portion side of the cover 100*a*. The platen cover 200 is provided on the copier main body 100 in an rotatable manner with one side edge as a rotational center. The control panel 300 is an input unit for copy operation and is provided on a top surface of the copier main body 100. The paper feeding cassette 400 is for containing paper and is provided on a lower side of the copier main body 100 in a removable manner. In addition, a paper delivering unit 600 is provided on top of a portion where the first to fourth toner cartridges 501 to 504 are provided.

Each of the first to fourth toner cartridges 501 to 504 is provided in a removable manner in a cartridge holding mechanism 505. The first to fourth toner cartridges 501 to 504 are for supplying toner of yellow, magenta, cyan, and black.

Next, a configuration of the first toner cartridge 501 will be described with reference to FIG. 2. Description of configurations of the second to fourth toner cartridges 502 to 504 will be omitted, since such configurations are almost same as the configuration of the first toner cartridge 501.

Figure 2:
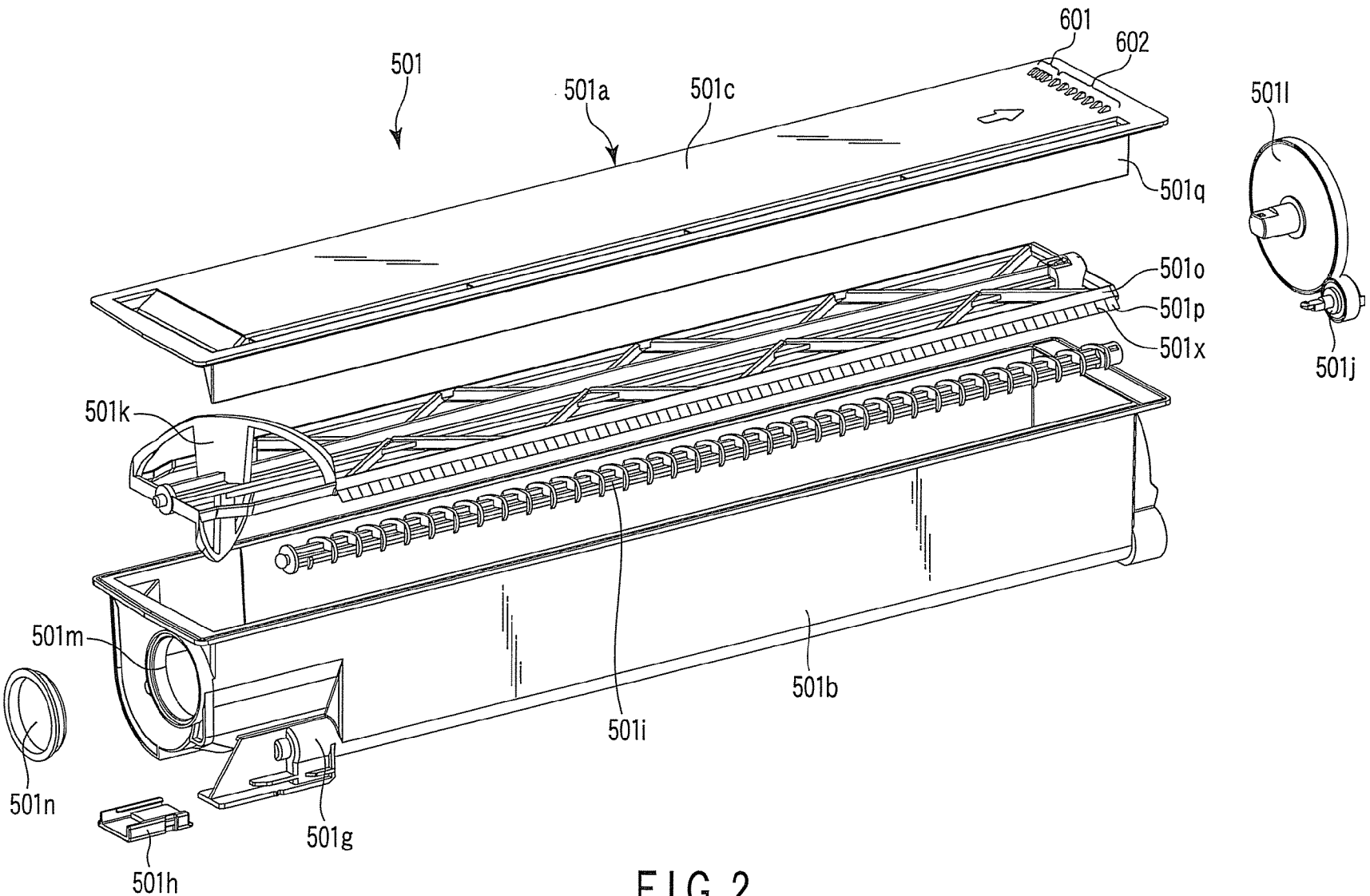
FIG. 2 is a perspective view showing a toner cartridge according to the present embodiment as viewed from an upper front side.

FIG. 2 is a perspective view showing an entire configuration of the first toner cartridge 501 according to the present embodiment viewed from a front surface side. Here, a surface with a cap 501*n* of the first toner cartridge 501 is the front surface side, and a surface with a mixer gear 501*l* is a rear side.

As shown in FIG. 2, the first toner cartridge 501 includes a cartridge main body 501*a* working as a toner container for containing the toner. The cartridge main body 501*a* is configured with a container body 501*b* and a lid body 501*c*. Also, first and second discriminating protrusion units 601 and 602 for discriminating toner information are provided on a rear side of the cartridge main body 501*a*.

The container body 501*b* has a U-shaped cross section. The lid body 501*c* has a rectangular plate shape. On a front surface side of the container body 501*b*, there is provided a discharging unit 501*g* which discharges the toner in the cartridge main body 501*a* and works as a toner supplying opening for supplying the toner in the image forming apparatus 1. The discharging unit 501*g* projects downwardly from a bottom surface of the container body 501*b*. On a bottom edge part of the discharging unit 501*g*, there is provided a shutter 501*h* for opening and closing a discharging opening (shown in FIGS. 11A, 11B, 12A and 12B) formed on the discharging unit 501*g*.

At the inner bottom of the containing unit 501*b*, there is provided a screw 501*i* working as a conveying member for conveying the toner in the cartridge main body 501*a* to the discharging unit 501*g*. On an end part on a rear surface side of the screw 501*i*, there is provided a coupling member 501*j* working as a driving member. The coupling member 501*j* is connected to a driving apparatus 700 (shown in FIGS. 8A and 8B) provided in the copier main body 100, and rotationally driven every time the toner is supplied.

Inside the cartridge main body 501*a*, there is provided a mixer 501*k* for agitating the toner in the cartridge main body 501*a*. At an end part on a rear surface of the mixer 501*k*, there is provided a mixer gear 501*l*. The mixer gear 501*l* meshes with the coupling member 501*j* working as a gear provided in the screw 501*i*. When the screw 501*i* is rotated, the mixer gear 501*k* is configured to rotate in association therewith.

On a front surface side of the container body 501*b*, there is formed a filling opening 501*m* used for filling the toner in the cartridge main body 501*a*. The filling opening 501*m* has a circular shape, and is sealed with the cap 501*n*.

Figure 3:
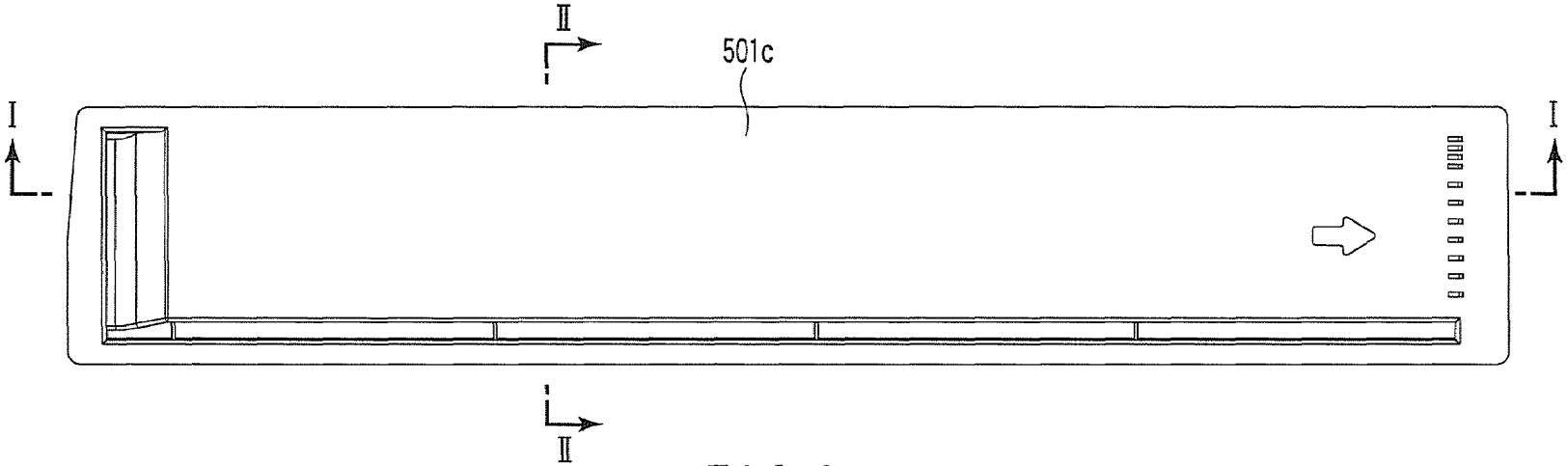
FIG. 3 is a plan view showing the toner cartridge according to the present embodiment as viewed from above.
Figure 4:
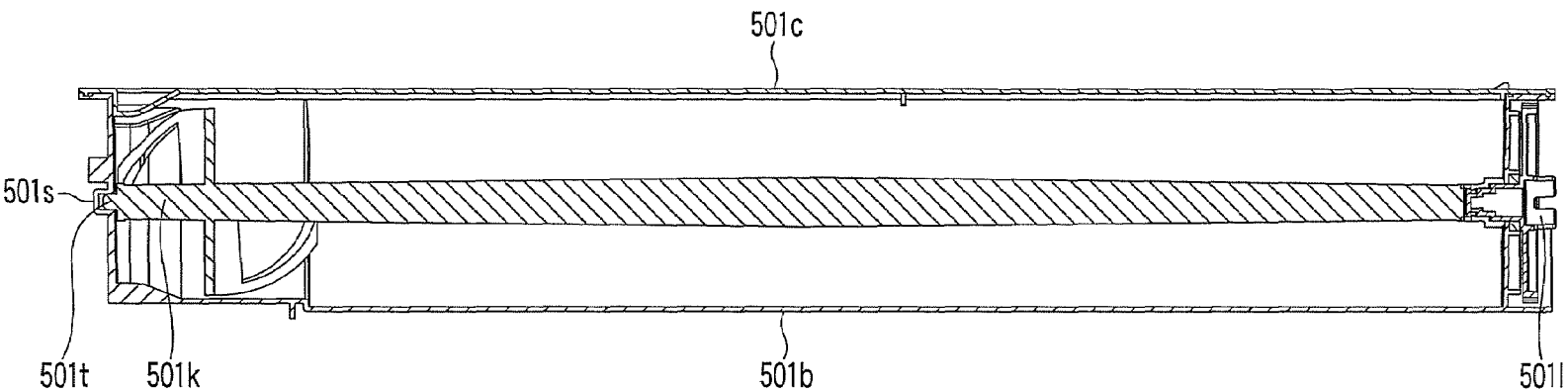
FIG. 4 is a transverse cross-sectional view showing an internal structure of the toner cartridge according to the present embodiment.

FIG. 3 is a view of the first toner cartridge 501 viewed from above a top surface. In addition, FIG. 4 shows a cross-sectional view of the first toner cartridge 501 cut along the line I-I in FIG. 3. The mixer 501*k* is fixed as described below. On a rear side surface of the first toner cartridge 501, the mixer 501*k* connects with the mixer gear 501*l* with a coupling unit interposed therebetween. In addition, on a front surface side of the first toner cartridge 501, the mixer 501*k* has a convex part 501*t* formed in a convex shape at an end part, and fits in a concave part 501*s* provided on a front surface side of the container body.

Here, an inner diameter of the concave part 501*s* is little larger than an outer diameter of the convex part 501*t*. For this reason, when the mixer 501*k* rotates to agitate the toner, the toner enters into a little gap between the convex part 501*t* and the concave part 501*s*. In this manner, friction between the convex part 501*t* and the concave part 501*s* is reduced, and the mixer 501*k* can rotate smoothly.

Figure 5:
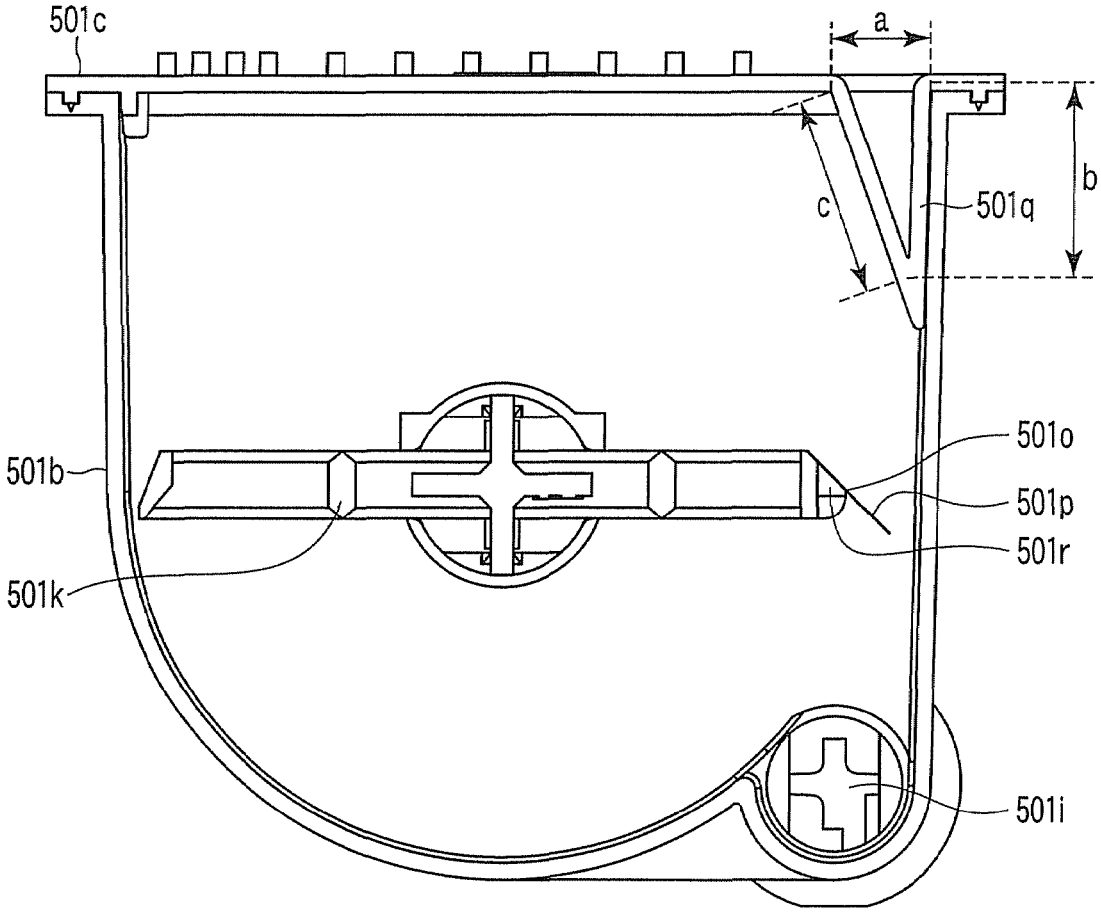
FIG. 5 is a vertical cross-sectional view showing the internal structure of the toner cartridge according to the present embodiment.

FIG. 5 shows a cross-sectional view of the first toner cartridge 501 cut along the line II-II in FIG. 3. The lid body 501*c* has a lid body protrusion part 501*q*. The lid body protrusion part 501*q* is provided at an upper edge of the container body 501*b* when the lid body 501*c* is inserted in the container body 501*b*. The lid body protrusion part 501*q* is a protrusion having a cross-sectional triangle shape enclosed by a line a, a line b, and an oblique line c. The line a has a predetermined length in a width direction from a connection of the lid body 501*c* and the container body 501*b*. The line b has a predetermined length from the connection of the lid body 501*c* and the container body 501*b* to the container body 501*b* and crosses the line a at a substantial right angle. The oblique line c is determined by the above two sides.

In addition, a surface enclosed by the line b having a predetermined length of the lid body protrusion part 501*q* and a longitudinal direction of the lid body 501*c* is formed such that the lid body 501*c* abuts the container body 501*b* without having any gap interposed therebetween when the lid body 501*c* is inserted in the container body 501*b*.

When the amount of the toner in the toner cartridge main body 501*a* becomes little, a gap appears between an outer periphery of the mixer 501*k* and an inner wall of the container body 501*b*. Therefore, the toner remaining in the gap cannot be conveyed by the mixer 501*k*. However, in the present embodiment, the lid body protrusion part 501*q* fills the gap appearing in the connection of the container body 501*b* and the lid body 501*c*. Therefore, the toner can be prevented from remaining in the gap.

Further, the lid body protrusion part 501*q* is provided with a surface having the oblique line c. Therefore, the toner adhered to the lid body protrusion part 501*q* easily flows down to an inside bottom of the container body 501*b*, and adherence of the toner hardly occurs.

In addition, as shown in FIGS. 2 and 5, a sweep sheet 501*o* is fixed on a mounting surface 501*r* which is an outer periphery part of the mixer 501*k*. In addition, a sweep part 501*p*, which is a free end not fixed on the mounting surface 501*r* of the sweep sheet 501*o*, projects in a further extended direction from an outer periphery part of the mixer 501*k*. The mixer 501*k* rotates counterclockwise in FIG. 5 which is a cross-sectional view of the first toner cartridge 501 viewed from a front surface side. For this reason, the sweep part 501*p* abuts the inner bottom of the container body 501*b*.

Further, as shown in FIG. 2, on the mounting surface 501*r* of the mixer 501*k*, there is inserted the sweep sheet 501*o* in a longitudinal direction. In addition, a plurality of cut parts 501*x* shown in FIG. 2 are formed on the sweep sheet 501*o* with predetermined intervals for an overall length in a width direction in a direction substantially parallel to a rotational axis.

When a driving force is transmitted from the driving apparatus 700 (shown in FIGS. 8A and 8B) to rotationally drive the coupling member 501*j*, the screw 501*i* is rotationally driven in an integrated manner, and the mixer 501*k* is rotationally driven via the mixer gear 501*l*. In this manner, the mixer 501*k* agitates and sends out the toner to the screw 501*i* at the same time. The screw 501*i* conveys the sent-out toner to the discharging unit 501*g*. Then, the toner is discharged from the discharging unit 501*g*. When the first toner cartridge 501 just starts to be used, the toner amount in the container body 501*b* is large. Even when the mixer 501*k* and the sweep sheet 501*o* rotate in an integrated manner, the toner in contact with the sweep part 501*p* passes through the cut parts 501*x* and flows toward a rear direction of the sweep part 501*p*. Therefore, the sweep sheet 501*o* never interferes with the rotation of the mixer 501*k*.

In addition, when the toner amount of the first toner cartridge 501 becomes small, a gap is formed between the outer periphery part of the mixer 501*k* and the inner wall of the container body 501*b*. Therefore, the toner remaining in the gap cannot be conveyed by the mixer 501*k*. However, the sweep sheet 501*o* abuts the inner bottom of the container body 501*b*. Therefore, the toner remaining in the gap can be sent out to the screw 501*i*. In this way, an amount of the remaining toner in the first toner cartridge 501 can be reduced.

Next, a discharging opening 501*z* of the first toner cartridge 501 and a toner supplying opening 800 in the image forming apparatus 1 at the time of mounting the first toner cartridge 501 will be described by using FIGS. 6 to 8B.

Figure 6:
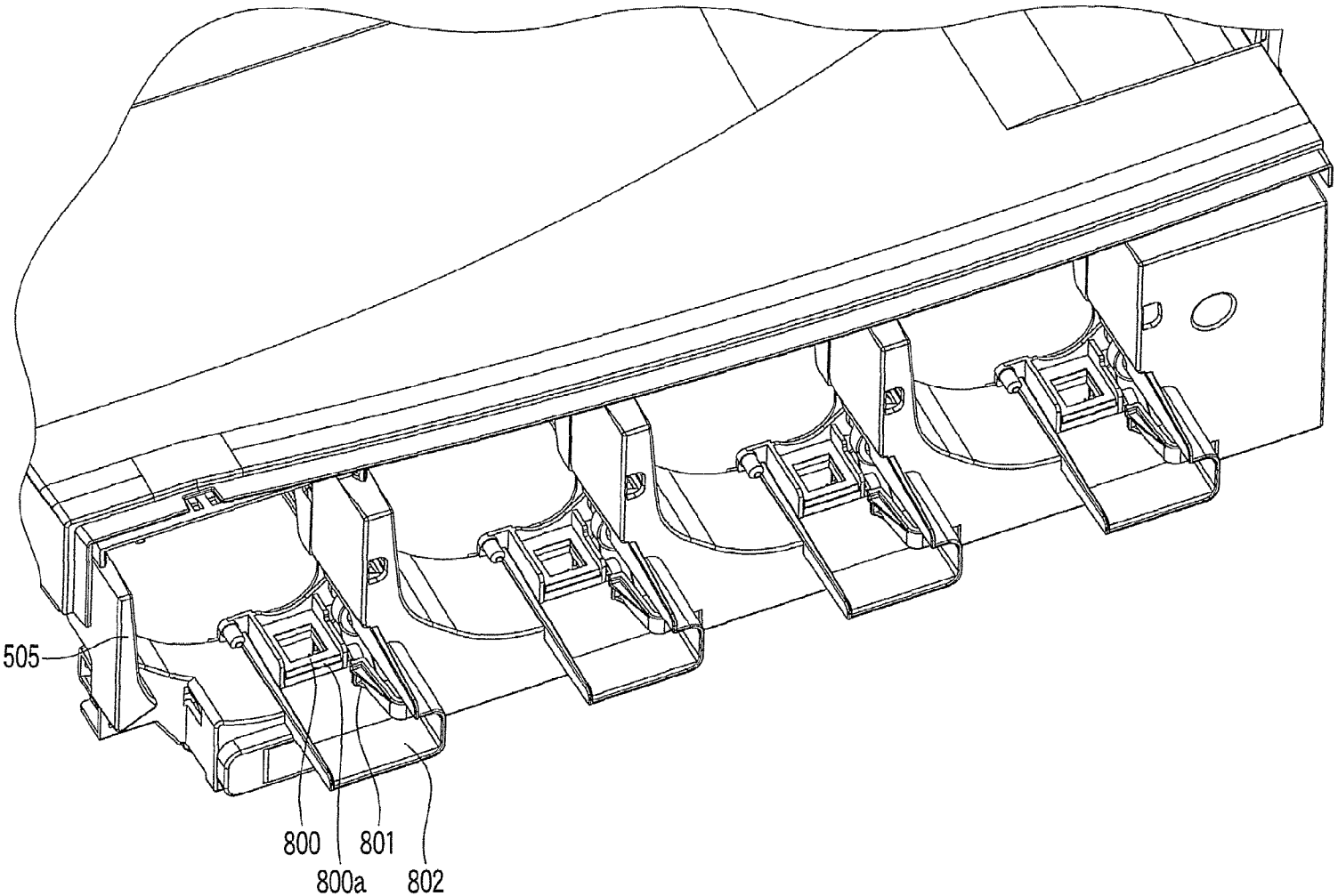
FIG. 6 is a perspective view of a cartridge holding mechanism according to the present embodiment as viewed from an upper front side.
Figure 7:
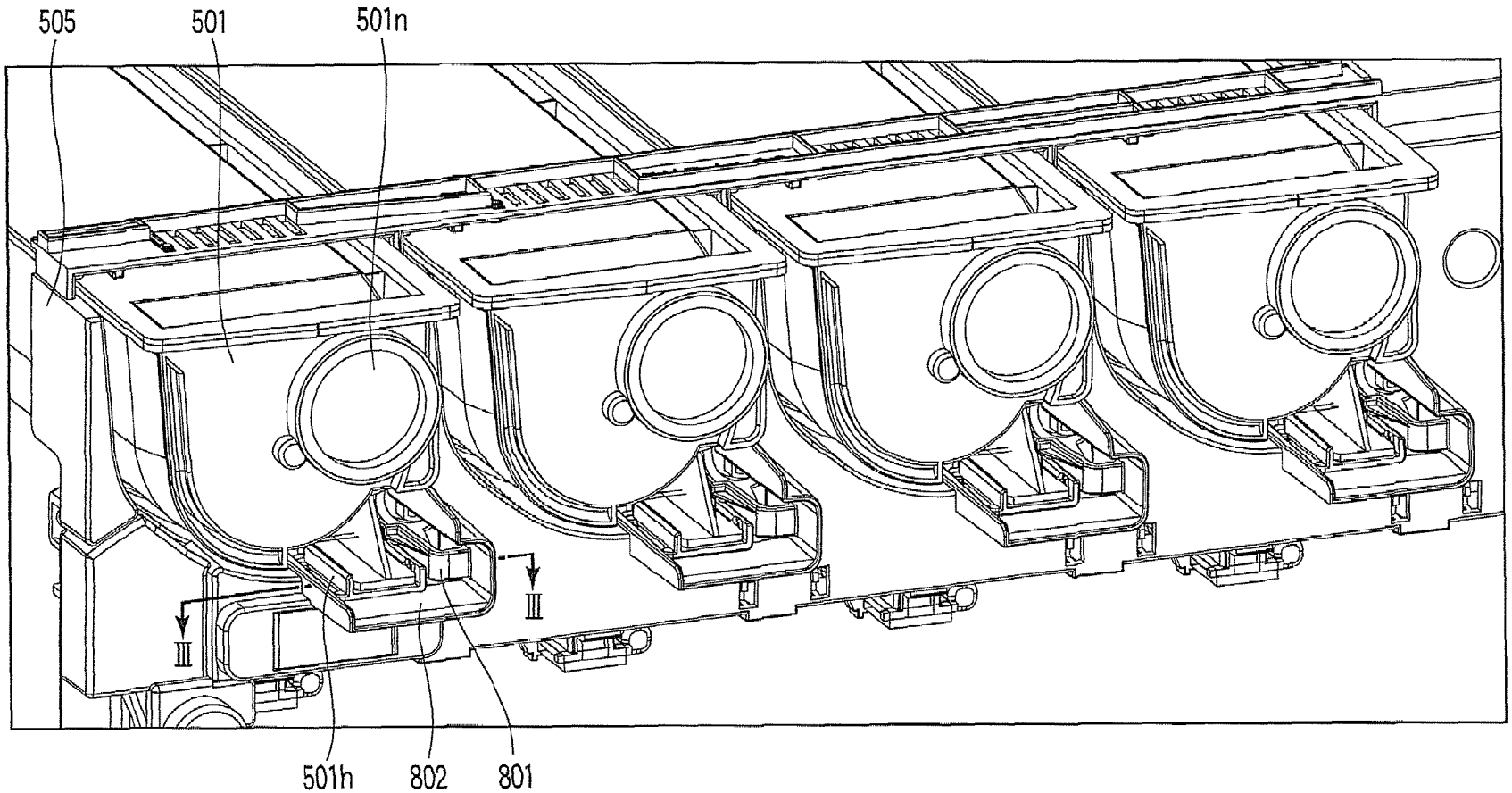
FIG. 7 is a perspective view of the cartridge holding mechanism and the toner cartridge according to the present embodiment as viewed from an upper front surface.
Figure 8A:
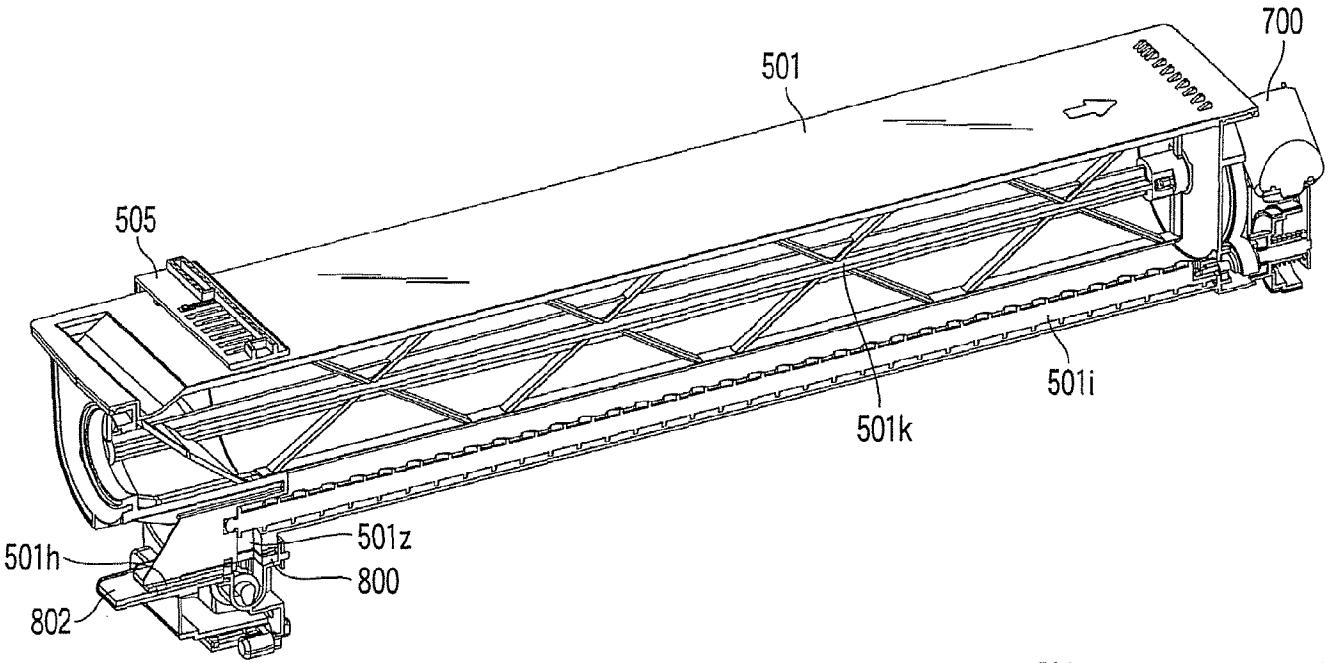
FIG. 8A is a horizontal cross-sectional perspective view of an internal structure of the cartridge holding mechanism and the toner cartridge according to the present embodiment.
Figure 8B:
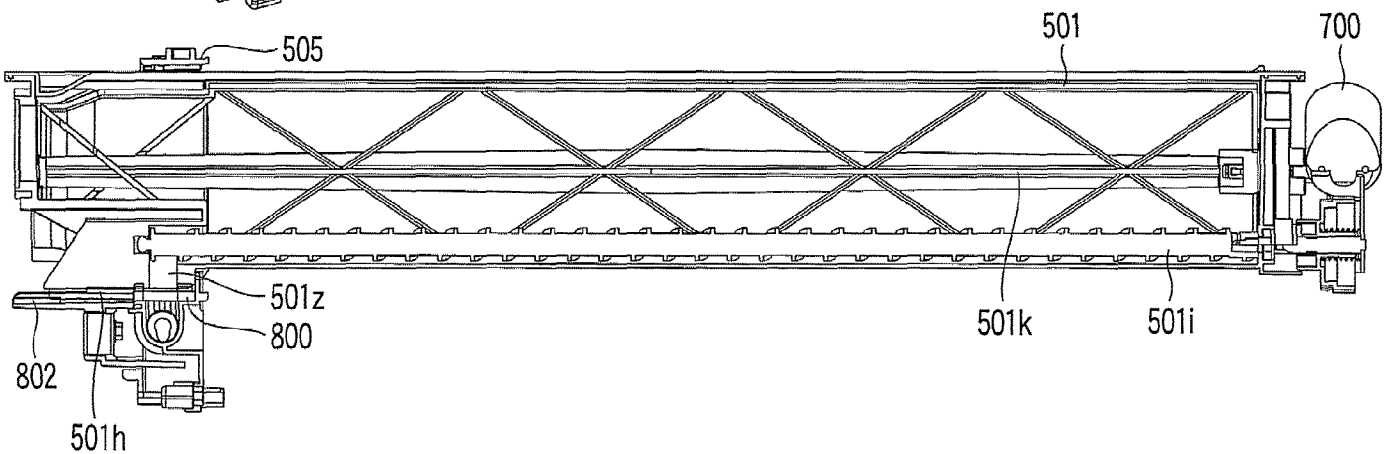
FIG. 8B is a horizontal cross-sectional view of an internal structure of the cartridge holding mechanism and the toner cartridge according to the present embodiment.

FIG. 6 is a perspective view of a cartridge holding mechanism 505 viewed from an upper front side. FIG. 7 is a perspective view of the cartridge holding mechanism 505 and the first toner cartridge 501 viewed from the upper front side when the first toner cartridge is inserted in the image forming apparatus 1. FIG. 8A is a horizontal cross-sectional perspective view of an internal structure of the cartridge holding mechanism 505 and the first toner cartridge 501 viewed from the upper front side when the first toner cartridge 501 is inserted in the image forming apparatus 1. FIG. 8B is a horizontal cross-sectional view of an internal structure of the cartridge holding mechanism 505 and the first toner cartridge 501 when the first toner cartridge 501 is inserted in the image forming apparatus 1.

As shown in FIG. 6, the cartridge holding mechanism 505 is provided on a front surface side of the image forming apparatus 1. In addition, when the first toner cartridge 501 shown in FIGS. 8A and 8B is inserted into the cartridge holding mechanism 505 along an arrow direction shown in the lid body 501*c*, a cap 501*n* and a shutter 501*h* of the first toner cartridge 501 are on a front surface side with respect to the image forming apparatus 1 as shown in FIG. 7.

Each slot of the cartridge holding mechanism 505 is provided with the toner supplying opening 800, a shutter holding mechanism 802, and a holding protrusion unit 801 as a holding member (refer to FIG. 6). As shown in FIGS. 8A and 8B, the toner supplying opening 800 is provided at a position facing the discharging opening 501*z* when the shutter 501*h* releases the discharging opening 501*z* of the first toner cartridge 501 at the time of mounting of the first toner cartridge 501 is completed. For this reason, toner filled in the first toner cartridge 501 flows out from the discharging opening 501*z* to the toner supplying opening 800.

In addition, the shutter holding mechanism 802 is provided so as to contact an exterior surface of the shutter 501*h*. Further, the holding protrusion unit 801 is shaped like a plate spring and has elasticity, and engages with a part of the shutter 501*h* to stop the shutter 501*h*.

Figure 9:
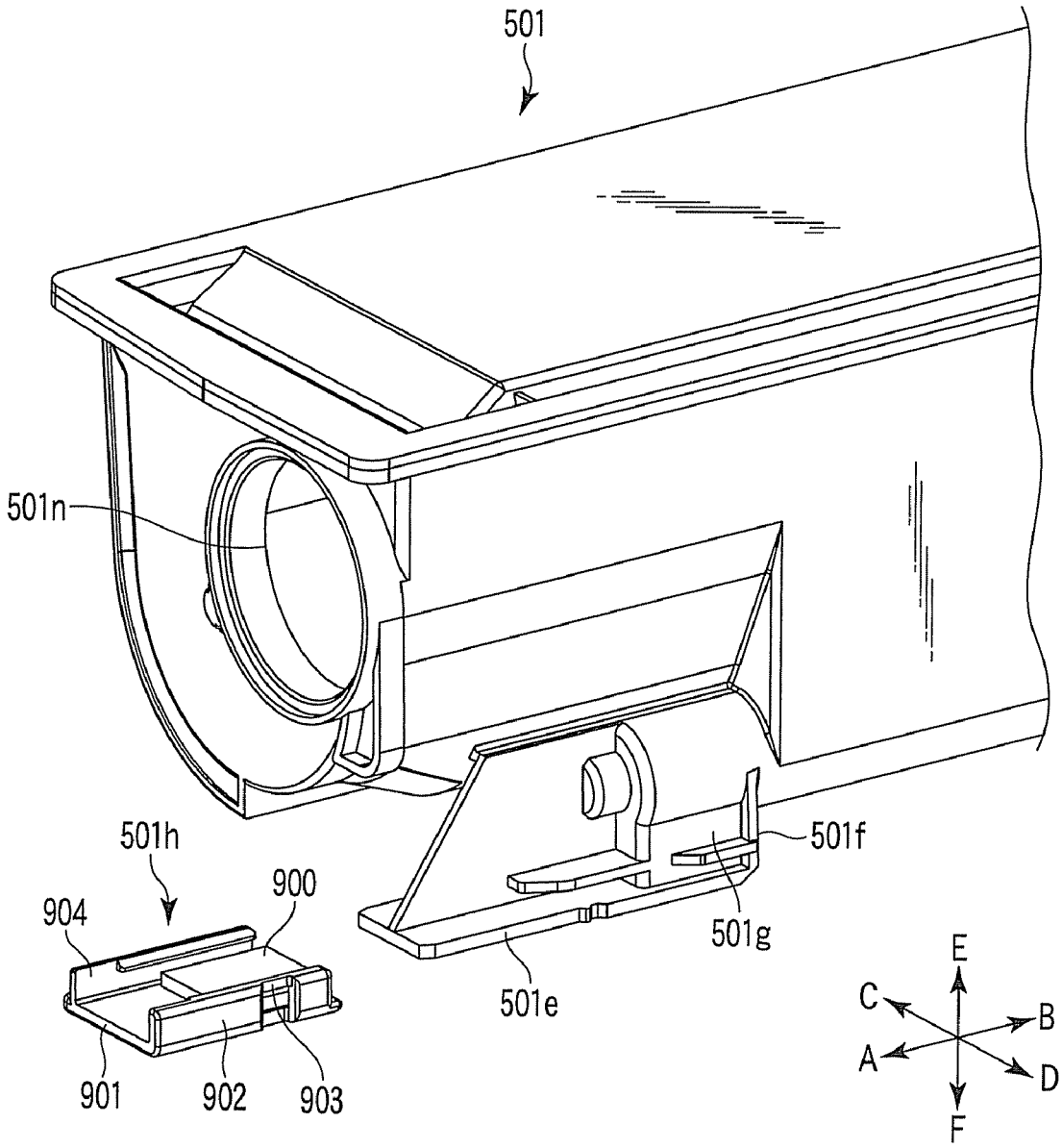
FIG. 9 is an enlarged perspective view of the toner cartridge according to the present embodiment as viewed from an upper front side.

Here, three dimensional directions are discriminated by an AB direction, a CD direction, and an EF direction shown in FIG. 9. The AB direction is an inserting/removing direction of the first toner cartridge 501, and a side (A side) having the cap 501*n* sealing the filling opening 501*m* of the first toner cartridge 501 is considered as a front surface side. Description will be made below as a side (B side) having the mixer gear 501*l* of the first toner cartridge 501. In addition, description will be made based on that, when viewed from the front surface side to the rear surface side, a right hand direction (D side) is a right side and a left hand direction (C side) is a left side. Description will be made below based on that, in a perpendicular direction with respect to a plane including two straight lines of the AB direction and the CD direction, an upper portion (E side) is an upper side and an lower portion (F side) is a lower side.

The holding protrusion unit 801 extends in a direction from an inserting opening of the first toner cartridge 501 of the cartridge holding mechanism 505 toward the inside of the apparatus so as to engage with a shutter concave part 903 of a first shutter side surface part 902 provided on a right side (refer to FIG. 9) of the shutter 501*h*. Also, the holding protrusion unit 801 is configured to be movable in a direction (CD direction) perpendicular to an inserting direction of the first toner cartridge 501 corresponding to movement of the first toner cartridge 501 at the time of the mounting and removing of the first toner cartridge 501 utilizing elasticity. That is, the holding protrusion unit 801 is configured to be shaped like a plate spring which has a base part on a front surface side of the cartridge holding mechanism 505 and provided along a direction from a front surface side to a rear surface side. Also, the holding protrusion unit 801 has a protrusion having a shape which engages with the shutter concave part 903 at an edge part on a free end side of the holding protrusion unit 801. In addition, the holding protrusion unit 801 is shaped to bend with the base part of the holding protrusion unit 801 as an axis, and has elasticity. A shape of the shutter 501*h* and a relationship between the holding protrusion unit 801 and the shutter 501*h* at the time of mounting and removing of the first toner cartridge 501 with respect to the image forming apparatus 1 are important points according to the embodiment of the present invention. Therefore, these points will be described later in detail.

The shape of the shutter 501*h* which is an important part of the present embodiment and an arrangement of the shutter 501*h* in the first toner cartridge 501 will be described by using FIGS. 9 to 12B.

FIG. 9 is an enlarged perspective view of the first toner cartridge 501 viewed from an upper front side, showing the first toner cartridge 501 in a state where the shutter 501*h* is pulled out from the first toner cartridge 501. Normally, the shutter 501*h* is combined with a guide member 501*e*.

Figures 10A, 10B, 10C:
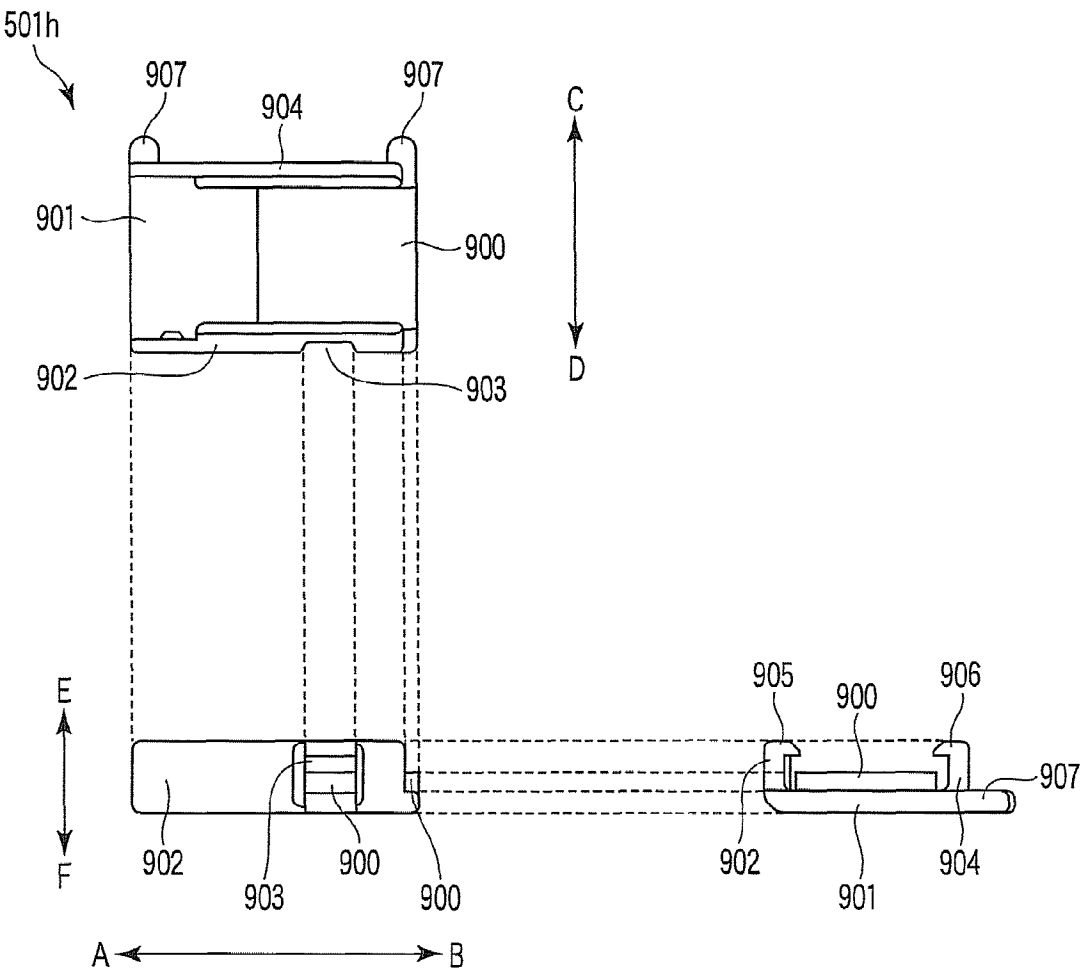
FIG. 10A is a plan view of a shutter according to the present embodiment as viewed from above.
FIG. 10B is a side view of the shutter according to the present embodiment as viewed from a side.
FIG. 10C is a rear view of the shutter according to the present embodiment as viewed from a rear side.
Figure 11A:
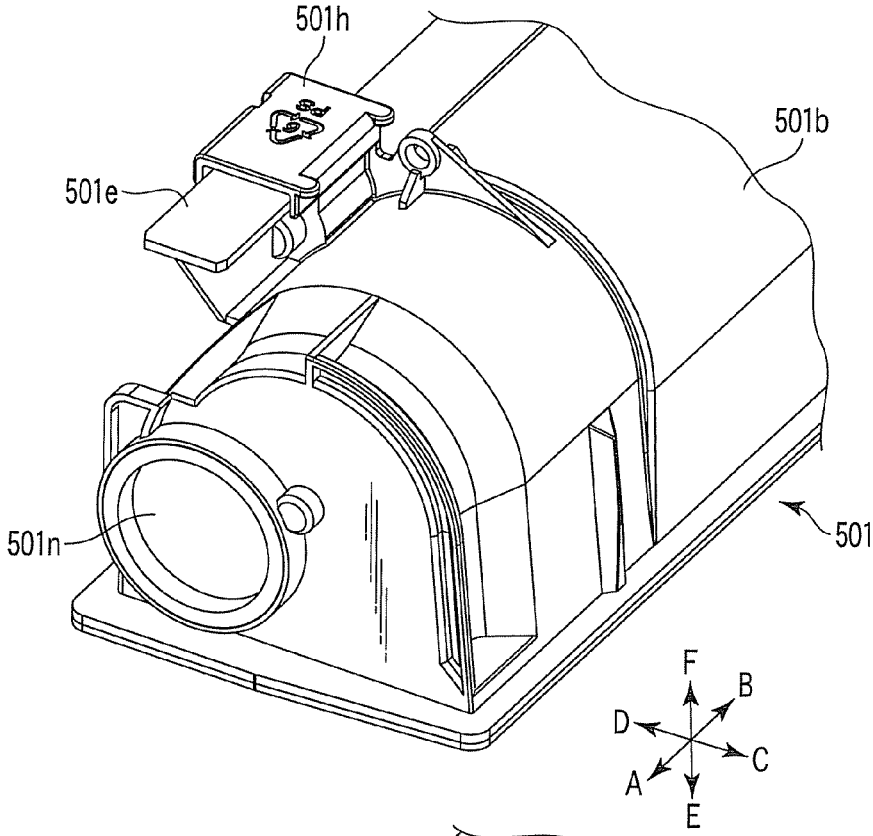
FIG. 11A is a perspective view of the toner cartridge according to the present embodiment as viewed from a lower front side.
Figure 11B:
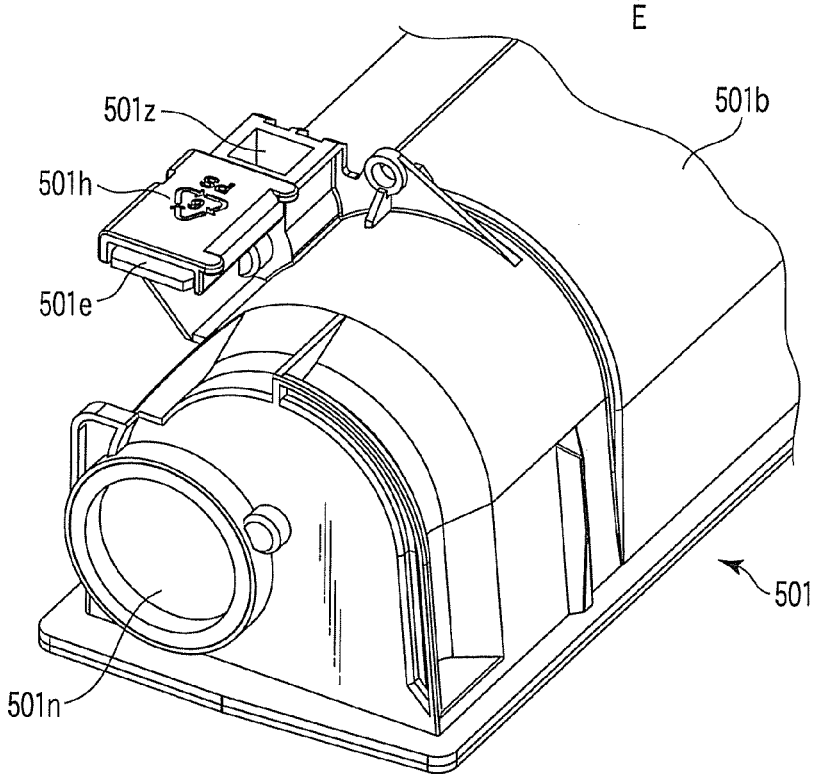
FIG. 11B is a perspective view of the toner cartridge according to the present embodiment as viewed from a lower front side.
Figure 12A:
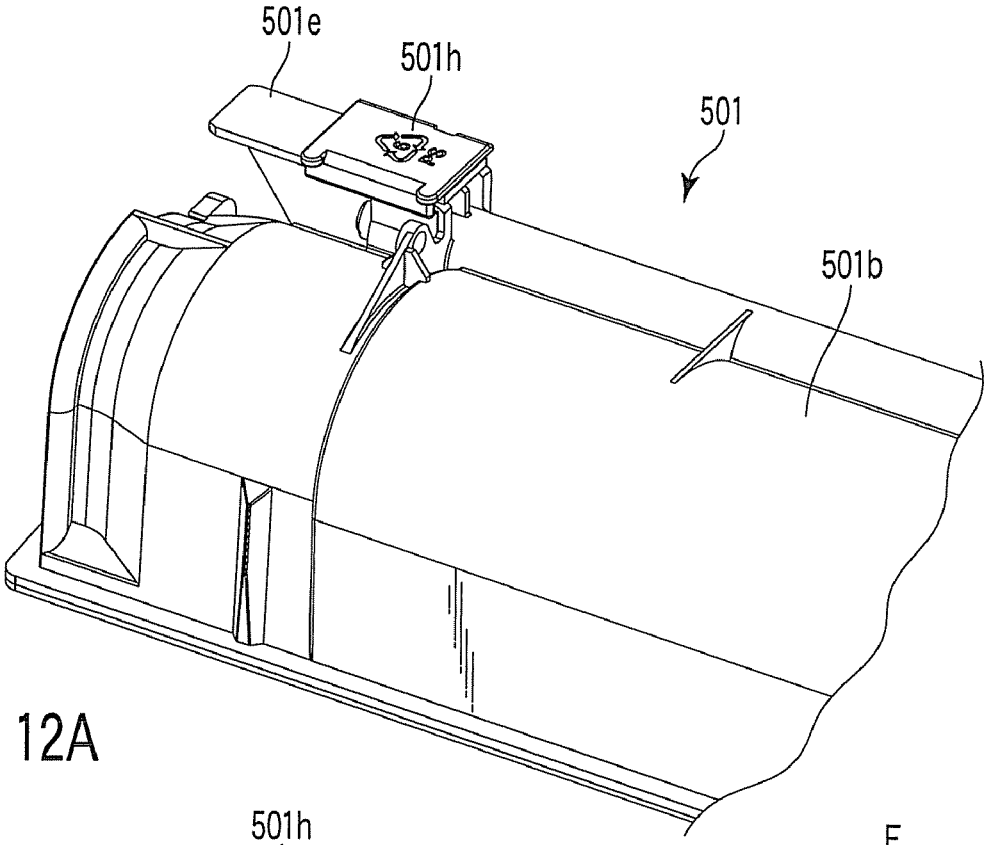
FIG. 12A is a perspective view of the toner cartridge according to the present embodiment as viewed from a lower back side.
Figure 12B:
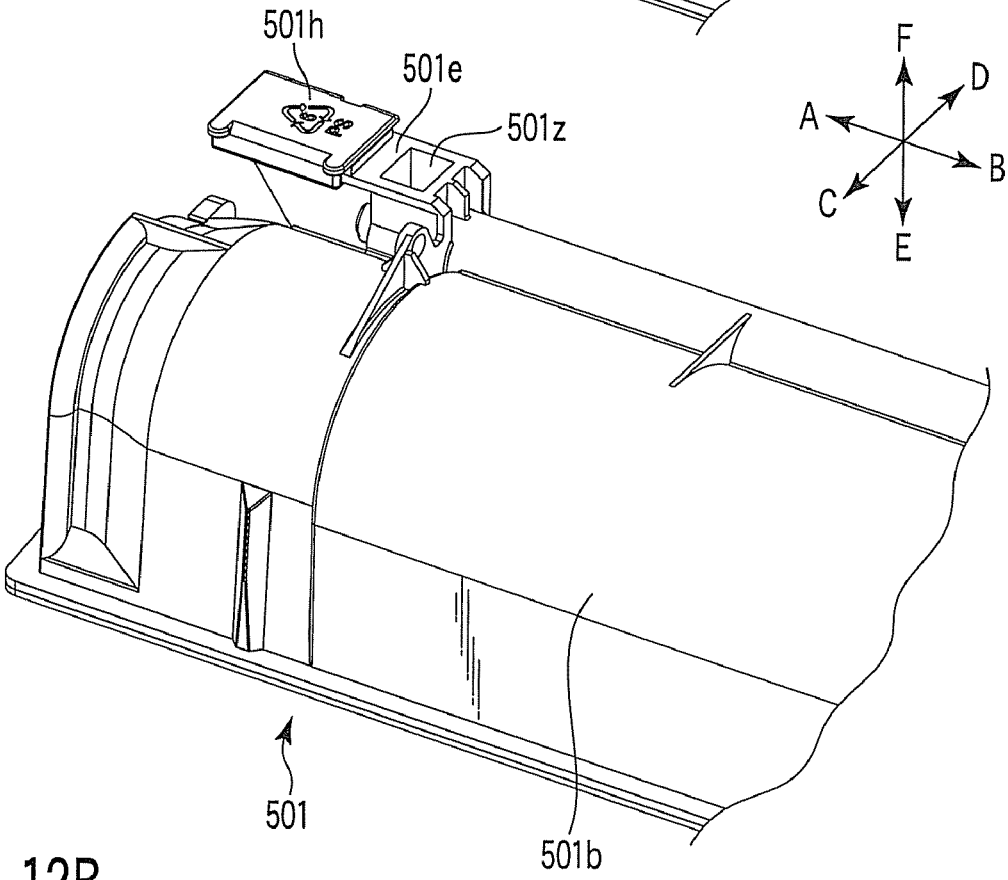
FIG. 12B is a perspective view of the toner cartridge according to the present embodiment as viewed from a lower back side.

FIG. 10A is a plan view of the shutter 501*h* viewed from above. FIG. 10B is a side view of the shutter 501*h* viewed from a right side. FIG. 10C is a rear view of the shutter 501*h* viewed from a rear surface side. FIG. 11A is a perspective view of a state where the shutter 501*h* blocks the discharging opening 501*z* of the first toner cartridge 501 viewed from a lower front side. FIG. 11B is a perspective view of a state where the shutter 501*h* opens the discharging opening 501*z* of the first toner cartridge 501 viewed from the lower front side. FIG. 12A is a perspective view of a state where the shutter 501*h* blocks the discharging opening 501*z* of the first toner cartridge 501 viewed from a lower back side. FIG. 12B is a perspective view of a state where the shutter 501*h* opens the discharging opening 501*z* of the first toner cartridge 501 viewed from the lower back side.

The shape of the shutter 501*h* will be described by using FIGS. 9, 10A, 10B and 10C. The shutter 501*h* includes a shutter bottom surface part 901, a first shutter side surface part 902, and a second shutter side surface part 904. The first shutter side surface part 902 contacts an edge of a right side of the shutter bottom surface part 901 in a perpendicular relationship, and has a predetermined height from a lower side toward an upper side. The second shutter side surface part 904 contacts an edge of the C side of the shutter bottom surface part 901 in a perpendicular relationship, and has the same height as the first shutter side surface part 902 from the F side toward the E side.

A first hooking part 905 is provided for a predetermined length along a longitudinal direction at an edge part of the first shutter side surface part 902 in a height direction. In addition, a second hooking part 906 is provided for a predetermined length along a longitudinal direction at an edge part of the second shutter side surface part 904 in a height direction. In addition, the first shutter side surface part 902 is provided with the shutter concave part 903 at a predetermined position.

In addition, a plurality of slide supporting members 907 are provided on an outer edge of a left side of the shutter bottom surface part 901. FIGS. 10A, 10B and 10C shows an example where two of the slide supporting members 907 are provided.

When mounting and removing the first toner cartridge 501 in and from the image forming apparatus 1, the shutter 501*h* is positioned close to the shutter holding mechanism 802 of the cartridge holding mechanism 505 shown in FIG. 6. A plurality of slide supporting members 907 are used for the shutter 501*h* to slide with respect to the shutter holding mechanism 802 positioned close to a left side of the shutter 501*h*. For this reason, a shape of the slide supporting member 907 is desirably one that is hard to cause friction with respect to the shutter holding mechanism 802. For example, as shown in FIG. 10A, the shape of the slide supporting member 907 may be semicircular.

In addition, by the shutter concave part 903 engaging with the holding protrusion unit 801 provided in the cartridge holding mechanism 505, the first toner cartridge 501 can be inserted in and removed from the image forming apparatus 1. For this reason, a force is applied to an engaging position between the shutter concave part 903 and the holding protrusion unit 801 when the first toner cartridge 501 is inserted and removed. Then, the shutter 501*h* is to be rotated around the engaging position. Here, the plurality of slide supporting members 907 are provided on a left side which is opposite to the right side where the shutter concave part 903 is provided, as shown in FIG. 10A. Therefore, by providing the plurality of slide supporting members 907, the rotational movement around the engaging position between the shutter concave part 903 and the holding protrusion unit 801 can be prevented. Other than the above, by providing the plurality of slide supporting members 907, rattle of the shutter 501*h* at the time of mounting and removing the first toner cartridge 501 can be prevented.

Further, a sealing member 900 is provided on a rear surface side of the shutter 501*h* which is a surface of the shutter bottom surface part 901 facing above. The sealing member 900 is provided at a position facing the discharging opening 501*z* such that the toner does not leak in a state where the shutter 501*h* blocks the discharging opening 501*z* of the first toner cartridge 501. The sealing member 900 is an elastic body. Silicon rubber, urethane, and sponge can be used as a material of the sealing member 900.

As shown in FIGS. 9, 11B, and 12B, a guide member 501*e* is formed such that an outer edge part of the discharging opening 501*z* provided in a discharging unit 501*g* is included in a bottom surface of the guide member 501*e*. The bottom surface of the guide member 501*e* is in a parallel relationship with the lid body 501*c* (refer to FIG. 2). The first hooking part 905 and the second hooking part 906 of the shutter 501*h* are hooked on an outer edge of the guide member 501*e* in a longitudinal direction. From the above configuration, the shutter 501*h* slides along a longitudinal direction of the guide member 501*e* as shown in FIGS. 11A and 11B (or FIGS. 12A and 12B). The sealing member 900 can open or close the discharging opening 501*z* of the first toner cartridge 501.

In addition, as shown in FIG. 9, a rib 501*f*, which is a protrusion, is provided on the discharging unit 501*g* in an outward direction. In addition, the rib 501*f* is provided at a position where the rib 501*f* does not contact the first shutter side surface part 902 of the shutter 501*h* when the shutter 501*h* slides in a direction to block the discharging opening 501*z* of the first toner cartridge 501.

Figures 13A, 13B, 13C:
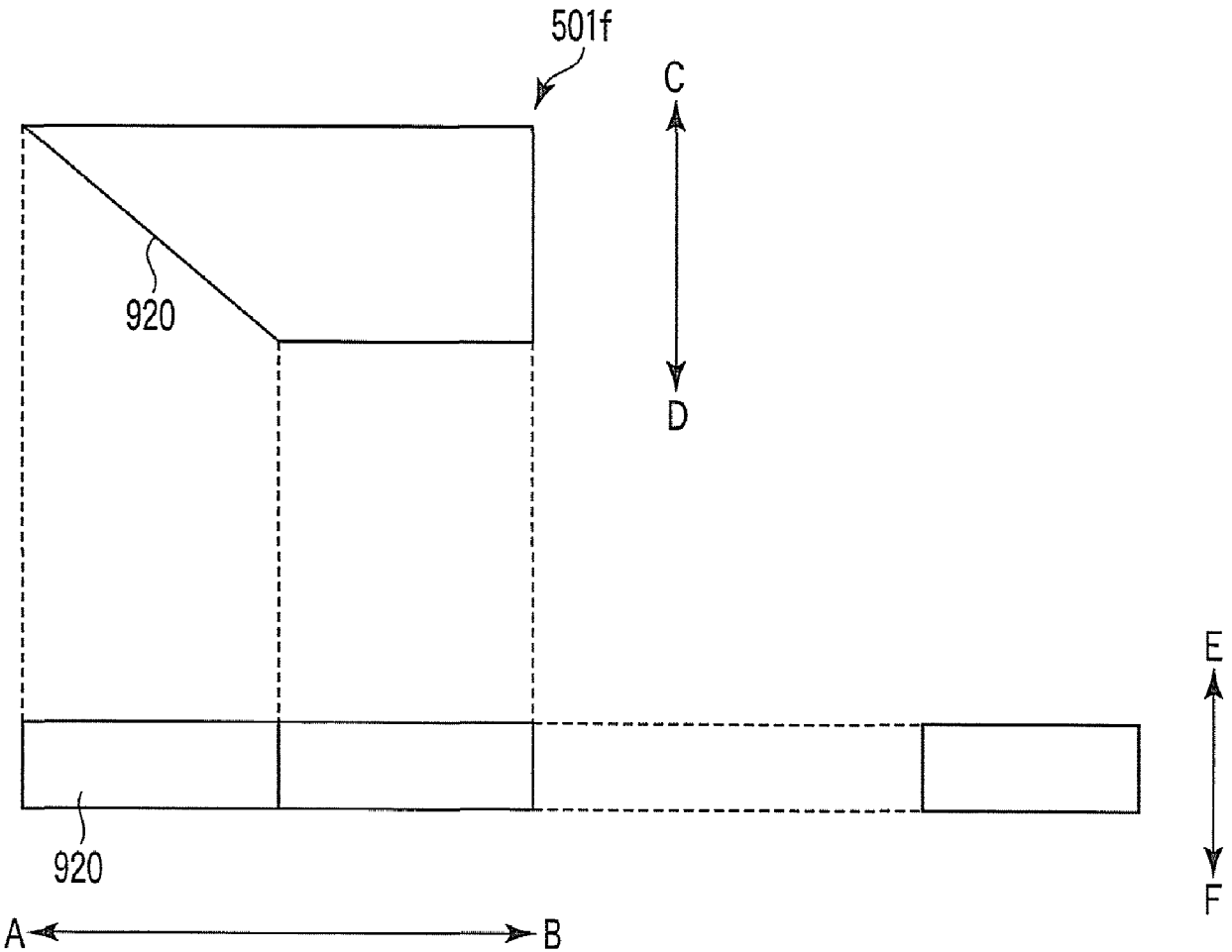
FIG. 13A is a plan view of a rib according to the present embodiment as viewed from above.
FIG. 13B is a side view of the rib according to the present embodiment as viewed from a side.
FIG. 13C is a rear view of the rib according to the present embodiment as viewed from a rear side.

FIGS. 13A, 13B and 13C show a shape of the rib 501*f*. FIG. 13A is a plan view of the rib 501*f* viewed from above (from upper side). FIG. 13B is a side view of the rib 501*f* viewed from a side surface (from right side). FIG. 13C is a rear view of the rib 501*f* viewed from a rear surface (from rear surface side). Definition of the front surface side, the rear surface side, the left side, the right side, above, and below shown in FIGS. 13A, 13B and 13C is similar to FIGS. 10A, 10B and 10C. On an exterior surface of the left side of the rib 501*f*, the discharging unit 501*g* of the first toner cartridge 501 is positioned.

In addition, the rib 501*f* has a rib inclination part 920 inclining along a direction from a front surface side toward a rear surface side. The rib inclination part 920 is an inclination in which width of the rib (CD direction) becomes wider as it goes from the front surface side toward the rear surface side. The rib 501*f* is used for separating the holding protrusion unit 801 engaging with the shutter concave part 903 of the shutter 501*h* from the shutter concave part 903 by utilizing an inclination of the rib inclination part 920 of the rib 501*f* when the first toner cartridge 501 is removed from the image forming apparatus 1.

A state in which the shutter 501*h* opens the discharging opening 501*z* of the first toner cartridge 501 when the first toner cartridge 501 is inserted or in which the shutter 501*h* blocks the discharging opening 501*z* of the first toner cartridge 501 when the first toner cartridge 501 is removed will be described by using FIGS. 14A to 16B. Further, a relationship between the holding protrusion unit 801 and the shutter 501*h* will be described in detail.

Figure 14A:
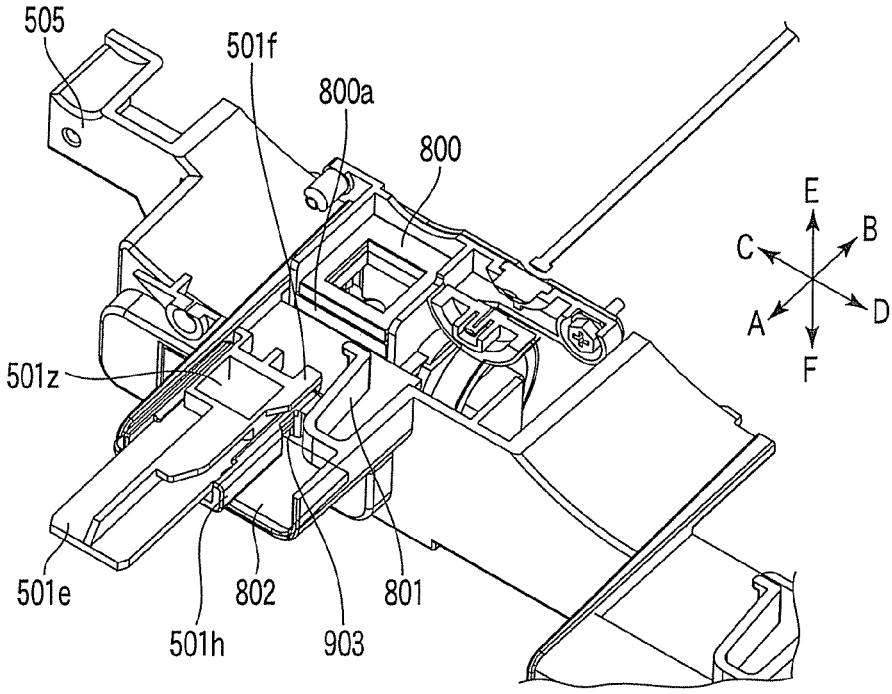
FIG. 14A is a cross-sectional perspective view showing the shutter and a toner supplying opening according to the present embodiment.
Figure 14B:
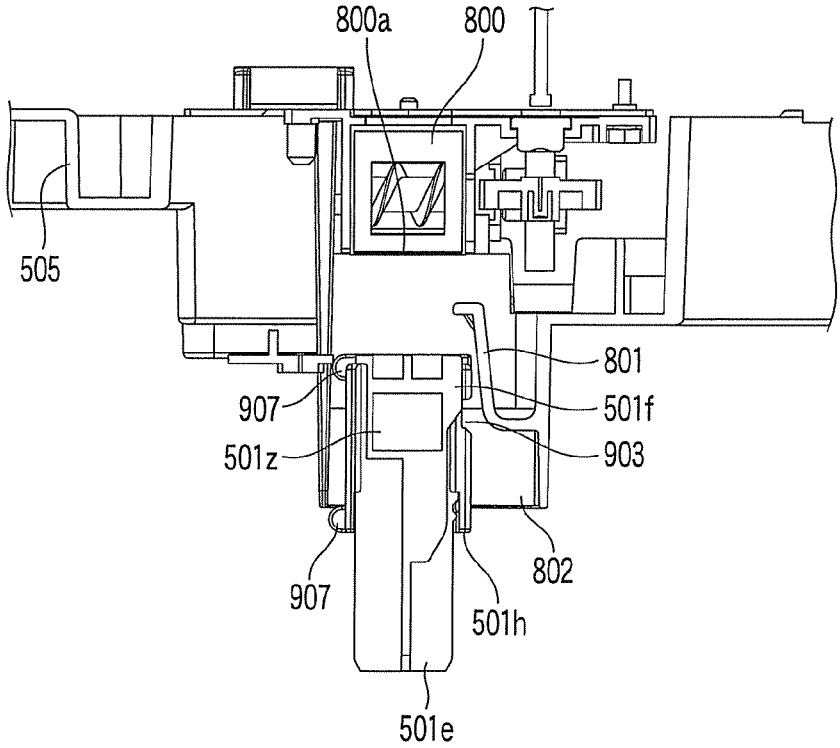
FIG. 14B is a cross-sectional view showing the shutter and the toner supplying opening according to the present embodiment.
Figure 15A:
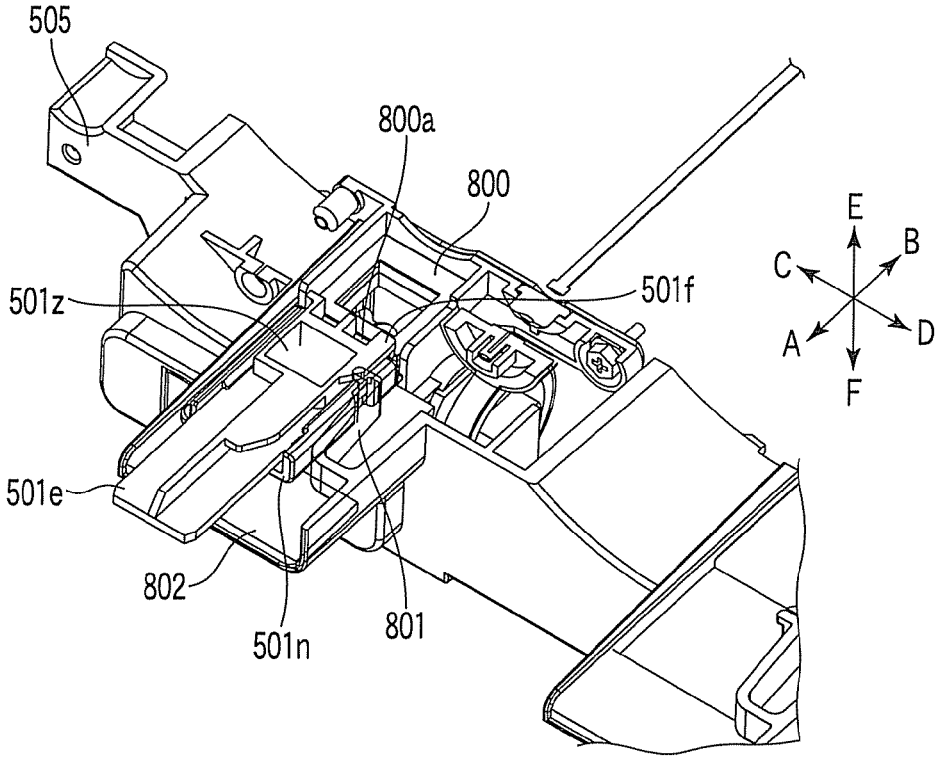
FIG. 15A is a cross-sectional perspective view showing the shutter and the toner supplying opening according to the present embodiment.
Figure 15B:
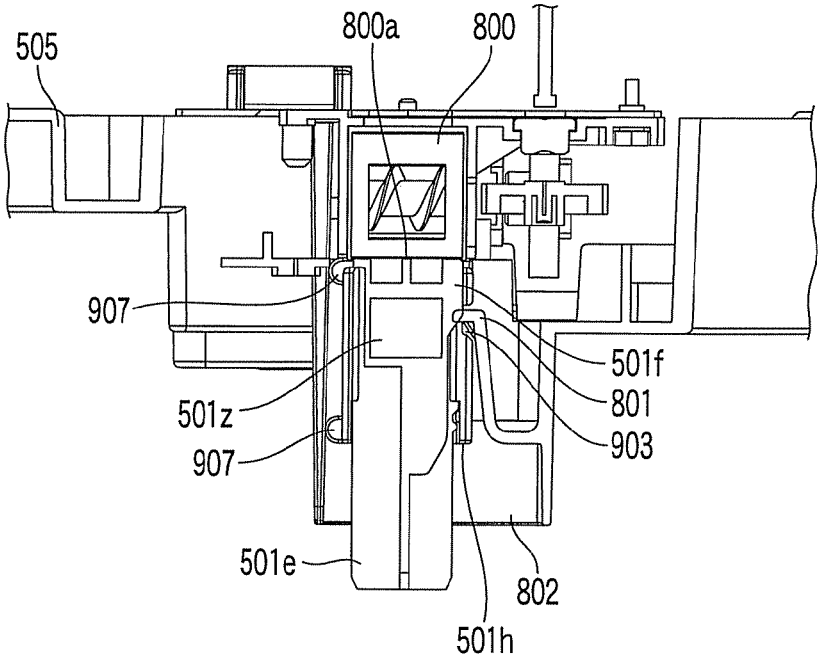
FIG. 15B is a cross-sectional view showing the shutter and the toner supplying opening according to the present embodiment.
Figure 16A:
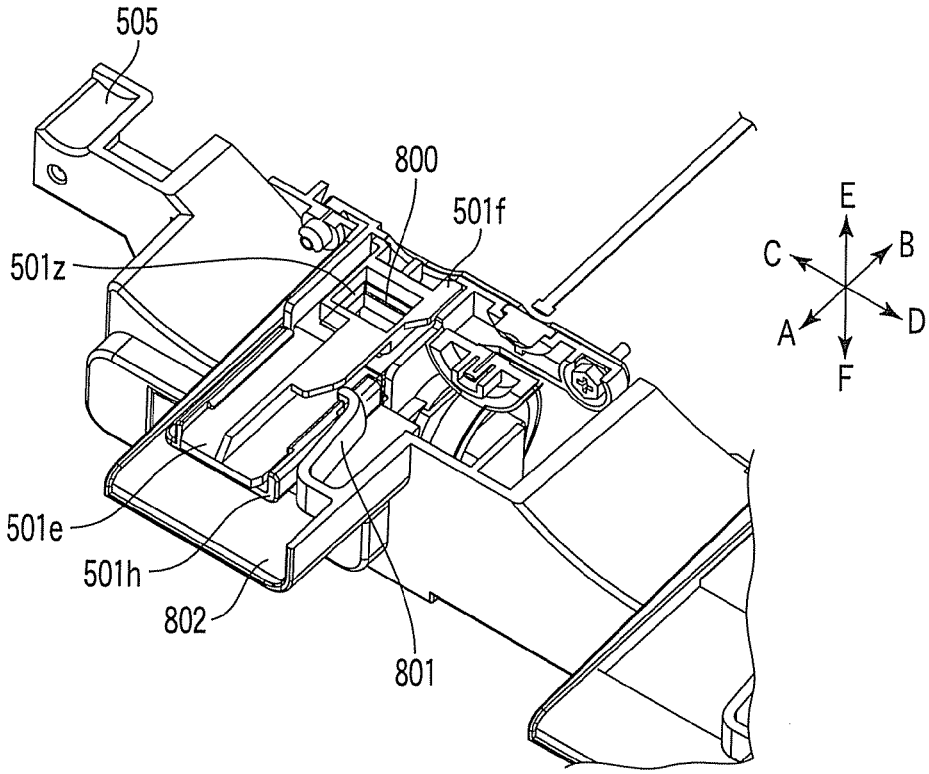
FIG. 16A is a cross-sectional perspective view showing the shutter and the toner supplying opening according to the present embodiment.
Figure 16B:
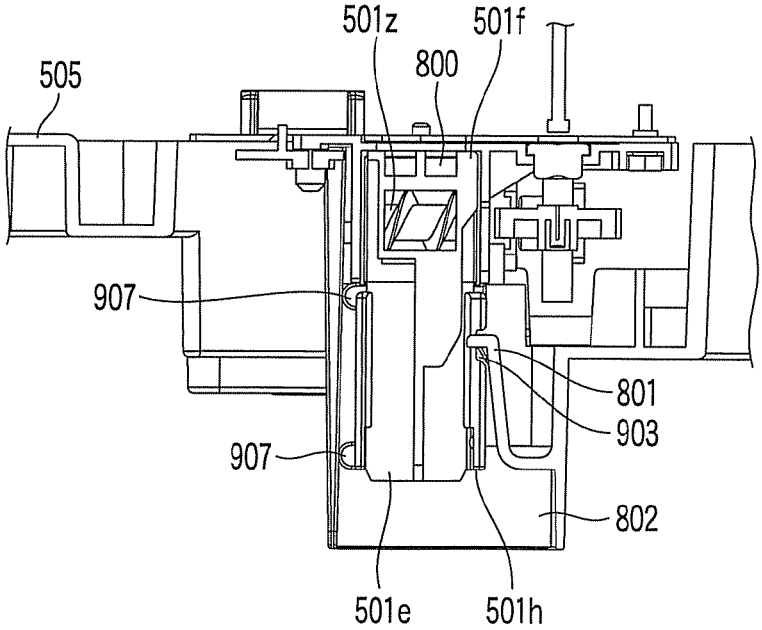
FIG. 16B is a cross-sectional view showing the shutter and the toner supplying opening according to the present embodiment.

FIGS. 14A, 15A, and 16A are a perspective view of a cross section of the shutter 501*h* and the toner supplying opening 800 cut along the line III-III shown in FIG. 7 viewed from an upper front side of the first toner cartridge 501. FIGS. 14B, 15B, and 16B are a plan view of a cross section of the shutter 501*h* and the toner supplying opening 800 cut along the line III-III shown in FIG. 7 viewed from above the first toner cartridge 501.

As to a flow of mounting the first toner cartridge 501 into the image forming apparatus 1, FIG. 14A (or FIG. 14B) shows a state at the start of the mounting, FIG. 15A (or FIG. 15B) shows a state in the middle of the mounting, and FIG. 16A (or FIG. 16B) shows a state at the completion of the mounting. In addition, as to a flow of removing the first toner cartridge 501 from the image forming apparatus 1, FIG. 16A (or FIG. 16B) shows a state at the start of the removing, FIG. 15A (or FIG. 15B) shows a state in the middle of the removing, and FIG. 14A (or FIG. 14B) shows a state at the completion of the removing. Here, an exterior surface of the shutter holding mechanism 802 contacting the shutter bottom surface part 901 of the shutter 501*h* is set as a reference surface. Then, a height direction is a direction perpendicular to an exterior surface of the shutter holding mechanism 802, that is, a perpendicular direction along a lower side to an upper side shown in FIGS. 10A, 10B and 10C or FIGS. 13A, 13B and 13C.

Here, when an exterior surface of the shutter holding mechanism 802 is set as a reference surface, the guide member 501*e* is formed such that a position of the bottom surface of the guide member 501*e* including an outer edge part of the discharging opening 501*z* is at the same position as the highest position of an outer edge part of the toner supplying opening 800. In addition, since the sealing member 900 is formed to block the discharging opening 501*z*, the position of the bottom surface of the guide member 501*e* including the outer edge part of the discharging opening 501*z* is at the same position as the top surface of the sealing member 900. For this reason, the sealing member 900 is formed such that the position of the top surface of the sealing member 900 is at the same position as the highest position of the outer edge part of the toner supplying opening 800 or higher. A protrusion at a front edge of the holding protrusion unit 801 is formed in a positional relationship to engage with the shutter concave part 903 of the shutter 501*h*. In addition, a position of the rib 501*f* provided on a side surface of the discharging unit 501*g* is the highest position in the height direction of the shutter 501*h* or higher, such that the rib 501*f* never contacts the shutter 501*h* when the shutter 501*h* is hooked on the guide member 501*e*. Further, the protrusion at the front edge of the holding protrusion unit 801 which is formed in the positional relationship where it engages with the shutter concave part 903 of the shutter 501*h* is formed to extend in the height direction to a position abutting the rib 501*f*.

First, a flow of mounting the first toner cartridge 501 into the image forming apparatus 1 (in the order of FIGS. 14A, 15A and 16A) will be described. As shown in FIG. 11A or FIG. 12A, the first hooking part 905 and the second hooking part 906 of the shutter 501*h* are hooked on an outside edge of the guide member 501*e* in a longitudinal direction. Before the first toner cartridge 501 is inserted into the image forming apparatus 1, the shutter 501*h* is in a state of blocking the discharging opening 501*z* provided on an exterior surface of the discharging unit 501*g* (FIGS. 11A and 12A).

As shown in FIGS. 14A and 14B, the first toner cartridge 501 is inserted into the image forming apparatus 1 along a direction from a front surface side to a rear surface side. The shutter holding mechanism 802 is provided so as to contact a bottom surface of the lower side of the shutter 501*h*.

As shown in FIGS. 15A and 15B, the first toner cartridge 501 is inserted into the image forming apparatus 1 along a direction from a position shown in FIGS. 14A and 14B and further from a front surface side toward a rear surface side. FIGS. 15A and 15B shows a state in which an exterior surface on a rear surface side of the shutter 501*h* contacts and faces an exterior surface part 800*a* which is an exterior surface of the toner supplying opening 800 and is orientated toward a front surface side. In this state, the shutter 501 blocks the discharging opening 501*z*. The exterior surface part 800*a* may be substituted by a locking part regulating further movement of the shutter 501*h*. In addition, the shutter 501*h* only needs to have a knocking part which knocks on the locking part.

In addition, when an exterior surface on a rear surface side of the shutter 501*h* contacts the exterior surface part 800*a* which is oriented to a front surface side on an exterior surface of the toner supplying opening 800, the rib 501*f* provided on a side surface of the discharging unit 501*g* presses the protrusion at the front edge of the holding protrusion unit 801. Then, the holding protrusion unit 801 bends from a left side to a right side.

Next, as shown in FIGS. 16A and 16B, the first toner cartridge 501 is inserted into the image forming apparatus 1 to the position where the mounting is completed from a position shown in FIGS. 15A and 15B further to a direction from a front surface side to a rear surface side. While the guide member 501*e* slides deep into the image forming apparatus 1, the rib 501*f* also moves deep inside the image forming apparatus 1. Then, in a state shown in FIGS. 15A and 15B, the protrusion at the front edge of the holding protrusion unit 801 is pressed. When the insertion of the first toner cartridge 501 is completed as shown in FIGS. 16A and 16B, the rib 501*f* bending the holding protrusion unit 801 from a left side to a right side moves to a position where the rib 501*f* does not abut the holding protrusion unit 801. Thereby, the protrusion at the front edge of the holding protrusion unit 801 returns to the original position in a manner from a right side to a left side, and fits into the shutter concave part 903 provided on a side surface of the shutter 501*h*. When the state in FIGS. 15A and 15B moves to the state in FIGS. 16A and 16B, the discharging opening 501*z* and the toner supplying opening 800 start to overlap each other gradually, and match with each other at last.

An exterior surface on a rear surface side of the shutter 501*h* faces and contacts the exterior surface part 800*a* which is an exterior surface of the toner supplying opening 800 and oriented to a front surface side. In this way, the shutter 501*h* is restricted from moving further to the rear surface side. In addition, since the protrusion at the front edge of the holding protrusion unit 801 fits in the shatter concave part 903 provided in the shutter 501*h*, movement of the shutter 501*h* is restricted. At this time, a force is applied to an engaging position between the shutter concave part 903 and the holding protrusion part 801 when the first toner cartridge 501 is inserted, and the shutter 501*h* is to be rotated around the engaging position. The slide supporting member 907 provided on an opposite side of the engaging position between the shutter concave part 903 of the shutter 501*h* and the holding protrusion unit 801 can prevent the rotational movement around the engaging position between the shutter concave part 903 and the holding protrusion unit 801. Other than the above, the slide supporting member 907 can prevent rattle of the shutter 501*h* at the time of mounting the first toner cartridge 501.

Further, since the guide member 501*e* is formed such that a position of a bottom surface of the guide member 501*e* including an outer edge part of the discharging opening 501*z* is at the same position as the highest position of an outer edge part of the toner supplying opening 800, the toner supplying opening 800 never interferes with movement of the guide member 501*e*. For this reason, when the first toner cartridge 501 is inserted into the image forming apparatus 1 along a direction from a front surface side to a rear surface side, the guide member 501*e* on which the first hooking part 905 and the second hooking part 906 of the shutter 501*h* hook slides, and the first toner cartridge 501 is inserted deep into the image forming apparatus 1.

Then, the first toner cartridge 501 can be inserted to a position where the discharging opening 501*z* of the first toner cartridge 501 and the toner supplying opening 800 provided in the image forming apparatus 1 face and match with each other. In this way, the insertion of the first toner cartridge 501 is completed. Therefore, the toner filled in the first toner cartridge 501 can be supplied to the image forming apparatus 1.

Next, a flow (in the order of FIGS. 16A, 15A and 14A) of removing the first toner cartridge 501 from the image forming apparatus 1 will be described.

At the start of removing as shown in FIGS. 16A and 16B, the discharging opening 501*z* of the first toner cartridge 501 and the toner supplying opening 800 provided in the image forming apparatus 1 are at positions where the openings face and match with each other. In addition, the protrusion at the front edge of the holding protrusion unit 801 fits into the shutter concave part 903 provided on a side surface of the shutter 501*h*. At this time, a force is applied to an engaging position between the shutter concave part 903 and the holding protrusion unit 801 when the first toner cartridge 501 is removed, and the shutter 501*h* is to be rotated around the engaging position. The slide supporting member 907 provided on an opposite side of the engaging position between the shutter concave part 903 of the shutter 501*h* and the holding protrusion unit 801 can prevent the rotational movement around the engaging position between the shutter concave part 903 and the holding protrusion unit 801. Other than the above, the slide supporting member 907 can prevent rattle of the shutter 501*h* at the time of removing the first toner cartridge 501.

FIGS. 15A and 15B show a state in the middle of removing the first toner cartridge 501 from the image forming apparatus 1 from a rear surface side along a front surface side after a state shown in FIGS. 16A and 16B. Since the shutter 501*h* engages with the shutter concave part 903 provided on a side surface of the shutter 501*h*, the shutter 501*h* does not move in association with the removing of the first toner cartridge 501 and temporary stays at the same position. For this reason, the guide member 501*e* on which the first hooking part 905 and the second hooking part 906 of the shutter 501*h* hook slides, and the first toner cartridge 501 is in a movable state in a direction of being removed from the image forming apparatus 1 from a rear surface side to a front surface side. The guide member 501*e* slides to a position where the shutter 501*h* completely blocks the discharging opening 501*z*. At this time, an edge part on a front surface side of the rib inclination part 920 of the rib 501*f* shown in FIGS. 13, 13B and 13C is positioned close to the protrusion of the front edge of the holding protrusion unit 801.

Further, when the first toner cartridge 501 is removed from the image forming apparatus 1 along a direction from a rear surface side to a front surface side from a state shown in FIGS. 15A and 15B to a state shown in FIGS. 14A and 14B, the rib 501*f* presses the holding protrusion unit 801 from a left side to a right side along an inclination of the rib inclination part 920. Then, the protrusion of the front edge of the holding protrusion unit 801 which engages with the shutter concave part 903 of the shutter 501*h* is disengaged from the shutter concave part 903. For this reason, the shutter 501*h* hooks on the guide member 501*e* and blocks the toner discharging opening 5, and the shutter 501*h* is in a state of being integrated with the guide member 501*e*. Then, the first toner cartridge 501 can completely be removed from the image forming apparatus 1. For this reason, when the first toner cartridge 501 is removed from the image forming apparatus 1, the toner can be prevented from falling from the discharging opening 501*z* provided in the first toner cartridge 501.

In addition, at an outer edge of the guide member 501*e* in a width direction, there is not a stationary part which interferes with the insertion and removal of the shutter 501*h* into and from the guide member 501*e*. Therefore, the shutter 501*h* can easily be removed from the guide member 501*e*. Although needless to point out, a plastic material is desirably recycled in view of an environmental aspect. The shutter 501*h* of the present embodiment can easily be removed from the guide member 501*e* of the first toner cartridge 501. Therefore, the shutter 501*h* can easily be removed and reused after the sealing member 900 is removed. Therefore, the shutter 501*h* has good recycling efficiency.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A toner cartridge comprising:

a toner cartridge main body which contains the toner;

discharging opening which supplies the toner contained in the toner cartridge main body;

a guide which is formed near an outer edge part of the discharging opening;

a shutter which engages the guide and slides along a predetermined direction to open/close the discharging opening;

one side of the shutter, which is parallel to the predetermined direction, having a concave formed therein for engaging with a holding member which holds the shutter provided in an image forming apparatus, and the other side of the shutter, faced with the one side of the shutter, having a slide supporting member which supports the shutter so as to slide on the guide; and an engaging supporting member which separates the holding member in a direction departing from the concave when the toner cartridge is removed.

2. The toner cartridge according to claim 1, wherein the holding member has a first edge part near an entrance or exit of the image forming apparatus at the time the toner cartridge is inserted or removed, and engages with the concave part of the shutter at the other edge part positioned on a deeper side in the image forming apparatus than the first edge part.

3. The toner cartridge according to claim 2, wherein the shutter is configured to be mountable and removable by sliding from the slide supporting member.

4. The toner cartridge according to claim 3, wherein the shutter is provided with an elastic body for completely sealing the discharging opening.

5. A toner cartridge comprising:

first means for containing toner;

second means for supplying the toner;

third means for sliding along a predetermined direction to open/close the second means, one side of the third means, which is parallel to the predetermined direction, having a concave formed therein for engaging with fourth means for holding the third means provided in an image forming apparatus, and the other side of the third means, faced with the one side of the third means, having fifth means for supporting the third means; and sixth means for separatina the fourth means in a direction departing from the concave when the toner cartridge is removed.

6. The toner cartridge according to claim 5, wherein the fourth means has a first edge part near an entrance or exit of the image forming apparatus at the time the toner cartridge is inserted or removed, and engages with the concave of the third means at the other edge part positioned on a deeper side in the image forming apparatus than the first edge part.

7. The toner cartridge according to claim 6, wherein the third means is configured to be mountable and removable by sliding from the fifth means.

8. The toner cartridge according to claim 7, wherein the third means is provided with an elastic body for completely sealing the second means.

* * * * *